US007285004B1

(12) United States Patent
Fukuda et al.

(10) Patent No.: US 7,285,004 B1
(45) Date of Patent: Oct. 23, 2007

(54) USB LOCKING CONNECTOR SYSTEM

(75) Inventors: Masaru Fukuda, Novi, MI (US); Larry Kim, Ann Arbor, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/255,141

(22) Filed: Oct. 20, 2005

Related U.S. Application Data

(60) Provisional application No. 60/673,644, filed on Apr. 21, 2005.

(51) Int. Cl.
*H01R 13/627* (2006.01)

(52) U.S. Cl. ..... 439/358; 439/354

(58) Field of Classification Search ..... 439/358, 439/357, 352, 607, 354
See application file for complete search history.

(56) References Cited

U.S. PATENT DOCUMENTS

| | | | | |
|---|---|---|---|---|
| 4,299,433 | A | 11/1981 | Jayne | |
| 4,640,566 | A | 2/1987 | Matsuaka | |
| 5,580,268 | A * | 12/1996 | Miyazawa | 439/352 |
| 5,941,733 | A | 8/1999 | Lai | |
| 6,126,474 | A | 10/2000 | Doye et al. | |
| 6,171,136 | B1 | 1/2001 | Liu et al. | |
| 6,315,600 | B1 | 11/2001 | Droesbeke | |
| 6,364,708 | B1 | 4/2002 | Chen et al. | |
| 6,386,918 | B1 | 5/2002 | Zheng et al. | |
| 6,435,911 | B1 | 8/2002 | Payson et al. | |
| 6,491,541 | B2 | 12/2002 | Wakino | |
| 6,579,113 | B2 * | 6/2003 | Kodama | 439/358 |
| 6,619,976 | B2 * | 9/2003 | Huetter et al. | 439/352 |
| 6,902,432 | B2 * | 6/2005 | Morikawa et al. | 439/607 |
| 7,014,490 | B1 * | 3/2006 | Morikawa et al. | 439/352 |
| 7,025,636 | B2 * | 4/2006 | Allen | 439/638 |
| 7,077,703 | B2 * | 7/2006 | Herlitz et al. | 439/607 |
| 7,104,842 | B1 * | 9/2006 | Huang et al. | 439/607 |
| 2002/0076962 | A1 | 6/2002 | Williams | |
| 2004/0166717 | A1 * | 8/2004 | Muro et al. | 439/358 |
| 2006/0134962 | A1 * | 6/2006 | Yeh | 439/352 |
| 2007/0004265 | A1 * | 1/2007 | Yeh | 439/358 |

FOREIGN PATENT DOCUMENTS

| | | | |
|---|---|---|---|
| JP | 11149964 | A | 6/1999 |

* cited by examiner

*Primary Examiner*—Hien Vu
(74) *Attorney, Agent, or Firm*—Harness, Dickey & Pierce, P.L.C.

(57) ABSTRACT

A Universal Serial Bus (USB) locking connector system is provided. The system can include a first housing defining a first locking portion and a female USB connector adapted to be disposed within the first housing. The system can also include a male USB connector operable to mate with the female USB connector. The system can further include a second housing defining a second locking portion. The second housing can be configured to receive the male USB connector. The second housing can be operable to engage the first locking portion with the second locking portion to fixedly couple the male USB connector to the female USB connector.

19 Claims, 4 Drawing Sheets

USB LOCKING CONNECTOR SYSTEM

CROSS-REFERENCE TO RELATED APPLICATIONS

This application claims the benefit of U.S. Provisional Application No. 60/673,644, filed on Apr. 21, 2005. The disclosure of the above application is incorporated herein by reference.

FIELD

The present invention relates to a connector system, and more particularly to a locking connector system for a universal serial bus (USB) connection.

BACKGROUND

Various connector systems exist for coupling a USB interface to a USB terminal. Typically, the USB connector system includes a USB cable with a USB interface adapted to mate with a USB terminal. The USB cable can include a cable body which facilitates a large number of mating cycles with the USB terminal while also providing a low release force to enable a consumer to easily and quickly remove the USB interface from the USB terminal. Thus, most USB connector systems have very low lock strength.

In addition, many USB connector systems are not designed to withstand high temperatures. Typical USB connector systems are generally designed to withstand ordinary room temperatures and the relatively low operating temperatures associated with computing equipment. The exposure of most USB connector systems to high operating temperatures can further reduce the release force provided by the USB interface, as the increased temperature can result in reduced rigidity of the locking mechanism.

Accordingly, it may be desirable to provide a USB locking connector system which can maintain its lock strength over a range of operating conditions.

SUMMARY

The various teachings can provide a Universal Serial Bus (USB) locking connector system. The system can include a first housing defining a first locking portion and a female USB connector adapted to be disposed within the first housing. The system can also include a male USB connector operable to mate with the female USB connector. The system can further include a second housing defining a second locking portion. The second housing can be configured to receive the male USB connector. The second housing can be operable to engage the first locking portion with the second locking portion to fixedly couple the male USB connector to the female USB connector.

Further areas of applicability of the present teachings will become apparent from the detailed description provided hereinafter. It should be understood that the detailed description and various examples, while indicating various embodiments, are intended for purposes of illustration only and are not intended to limit the scope of the teachings.

BRIEF DESCRIPTION OF THE DRAWINGS

The present invention will become more fully understood from the detailed description and the accompanying drawings, wherein.

DETAILED DESCRIPTION OF VARIOUS EMBODIMENTS

The following description of the various embodiments is merely exemplary in nature and is in no way intended to limit the teachings of the various embodiments, their application, or uses. Although the following description is related generally to a USB locking connector system that can be coupled to a mobile platform, such as a motor vehicle, it will be understood that the USB locking connector system, as described and claimed herein, can be used with any appropriate application. Therefore, it will be understood that the following discussions are not intended to limit the scope of the appended claims.

Figure 1:
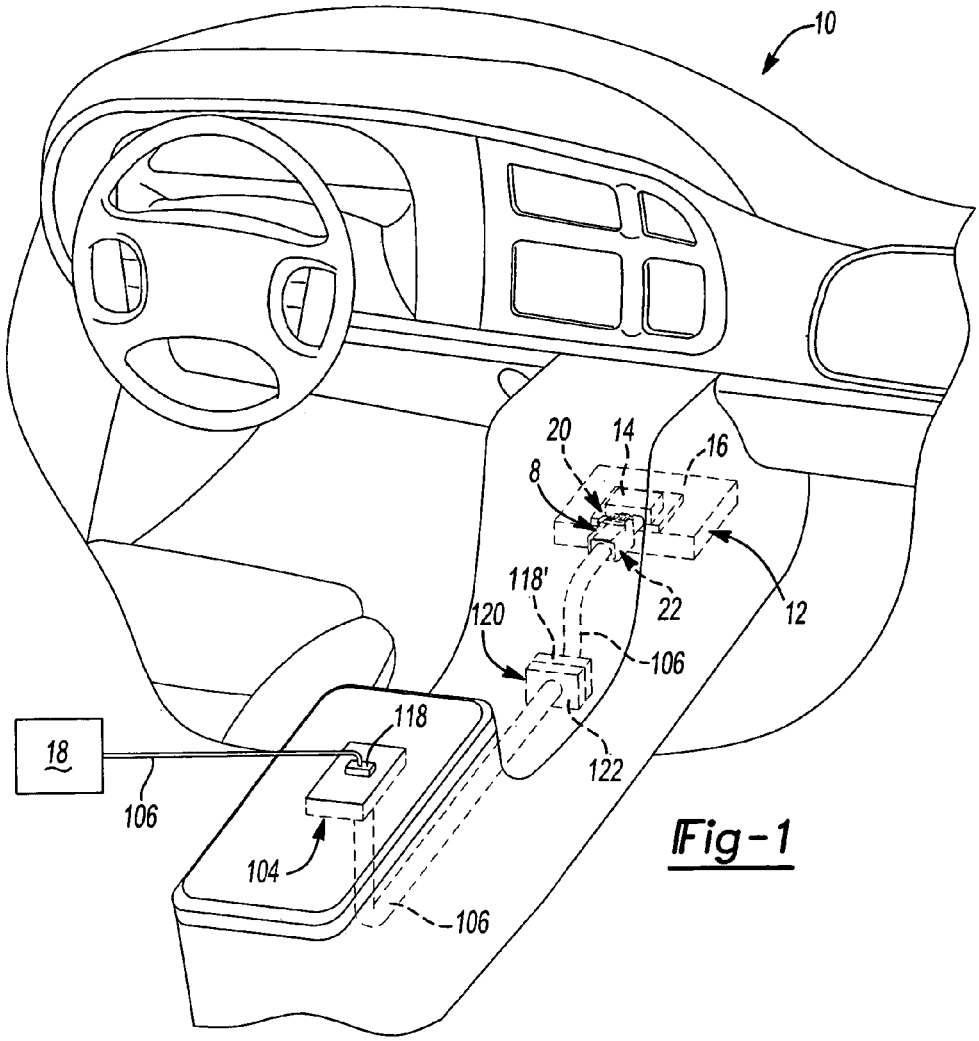
FIG. 1 is an environmental view of a USB locking connector system according to various teachings.

As will be discussed in more detail herein, a USB locking connector system 8 is taught. With reference to FIG. 1, an exemplary motor vehicle 10 which can include the USB locking connector system 8 is shown. The motor vehicle 10 can include a media device 12, such as a mini-computer, radio or navigation system. The media device 12 can include a hard drive 14 with a circuit board 16. The USB locking connector system 8 can be coupled to the circuit board 16 to enable the USB locking connector system 8 to be in communication with the hard drive 14. The USB locking connector system 8 can be used to enable data transfer between the hard drive 14 of the media device 12 and a user operated plug and play USB device or external media device 18, such as a digital camera, MP3 player or other USB plug and play devices. Generally, with additional reference to FIGS. 2 and 3, the USB locking connector system 8 can include a female connector system 20 and a male connector system 22.

Figure 4:
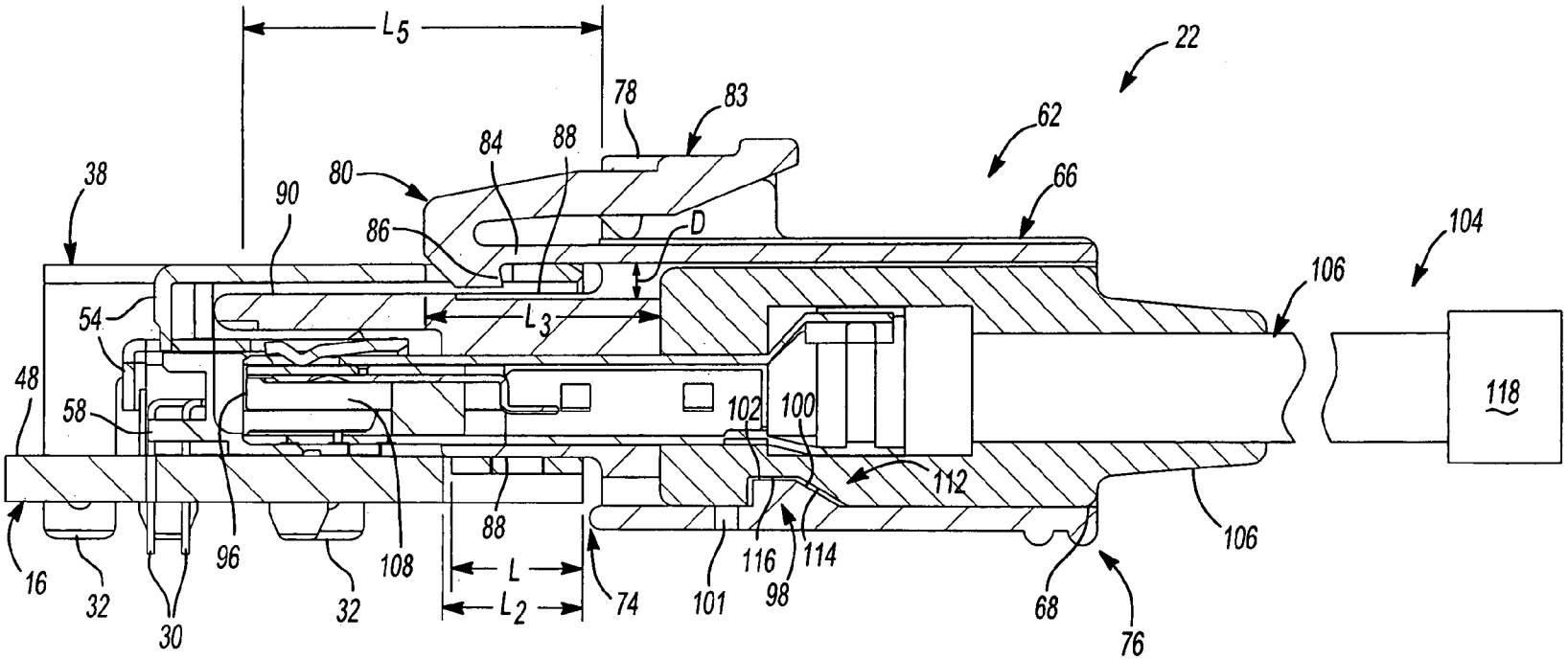
FIG. 4 is a cross-sectional view of the USB locking connector system of FIG. 2, illustrating the USB locking connector system, taken along line 4-4 of FIG. 2.

The female connector system 20 can be coupled to and in communication with the circuit board 16 of the media device 12, as best shown in FIG. 4. In general, the female connector system 20 can include a first housing or shroud 24 which can surround a female USB terminal 26. The female USB terminal 26 can be a mini-USB compatible terminal or a conventional USB terminal. As the data communication between the female USB terminal 26 and the hard drive 14 can be substantially identical to the data transfer associated with various home computer and/or music playback equipment, a detailed discussion of the data communication between the female USB terminal 26 and the hard drive 14 and of the construction of the female USB terminal 26 need not be provided herein.

Figure 2:
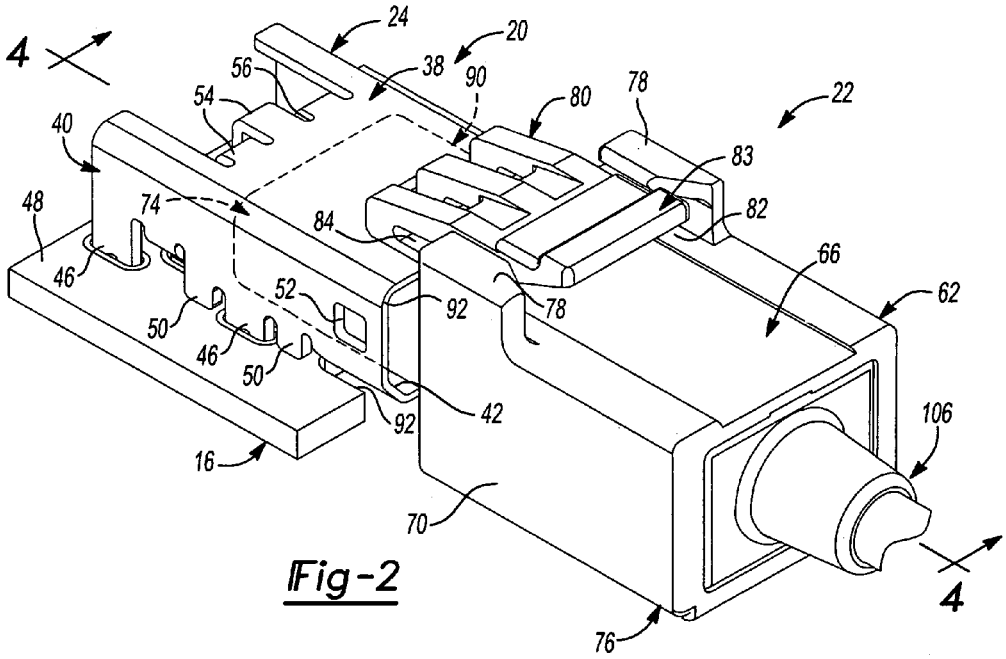
FIG. 2 is a detailed environmental view of the USB locking connector system of FIG. 1.
Figure 5:
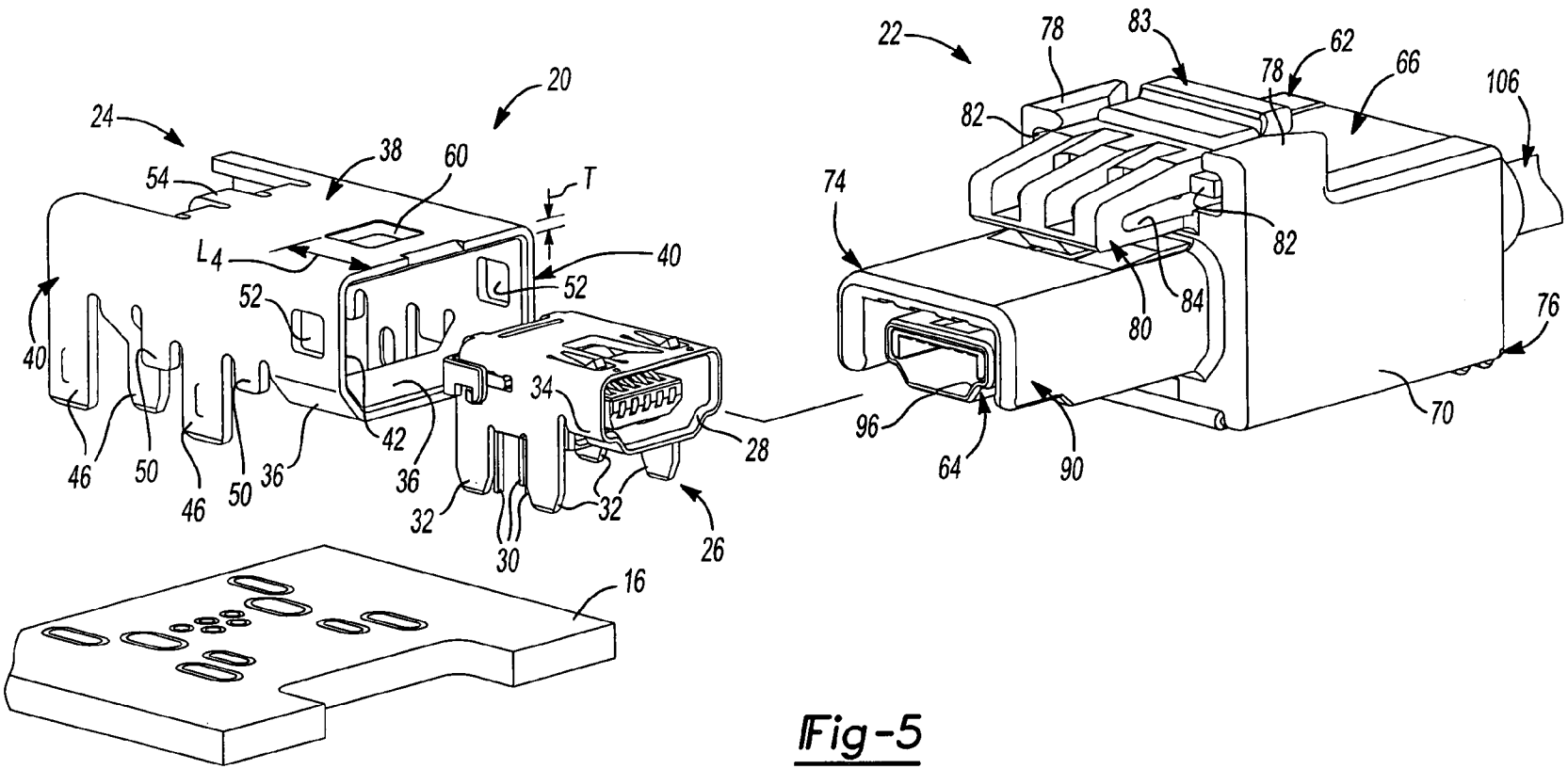
FIG. 5 is an exploded view of the USB locking connector system of FIG. 1.

In FIGS. 2, 4 and 5, the female USB terminal 26 can include terminals 28. The terminals 28 can be configured to engage the male connector system 22 (FIG. 1) and to also enable data transfer between the male connector system 22 (FIG. 1) and the hard drive 14 (FIG. 1). Generally, the terminals 28 can be coupled to and in communication with a plurality of wired contact posts 30. The wired contact posts 30 can be coupled to and in communication with the circuit board 16. The wired contact posts 30 could be soldered to a surface 48 of the circuit board 16, or the wired contact posts 30 could be press fit into the surface 48 of the circuit board 16, however, any appropriate method could be used to couple the female USB terminal 26 to the circuit board 16. Thus, the wired contact posts 30 can be operable to place the female USB terminal 26 in communication with the circuit board 16 to enable data transfer between the terminals 28 and the hard drive 14 (FIG. 1) through the wired contact posts 30 and the circuit board 16.

The female USB terminal 26 can further include one or more flanges 32. The flanges 32 can extend from a body 34 of the female USB terminal 26. The flanges 32 can be further used to couple the female USB terminal 26 to the circuit board 16, as the flanges 32 can be soldered to the circuit board 16 after the wired contact posts 30 are in position on the circuit board 16, however any appropriate coupling technique could be employed, such as the use of a mechanical fastener. In addition, one or more of the flanges 32 can be used to couple the female USB terminal 26 to the shroud 24, as will be described in greater detail below. The shroud 24 can surround the female USB terminal 26 to protect the wired contact posts 30 from wire strains.

The shroud 24 can be a container-like structure with a bottom surface 36, a top surface 38 and one or more sides 40. The shroud 24 can be formed of a metallic material, typically metals or metal alloys, however other materials could be employed. Generally, the shroud 24 can define an opening 42 that can be configured to surround the female USB terminal 26. The opening 42 can enable the shroud 24 to be positioned over the female USB terminal 26 such that the bottom surface 36 contacts a cut-out 44 formed in the circuit board 16, as will be described in greater detail below. A length L of the bottom surface 36 can be sized to correspond to a length L2 of the cut-out 44, and both the length L of the bottom surface 36 and length L2 of the cut-out 44 can be sized to as necessary to provide an alignment distance for coupling the female USB terminal 26 to the male connector system 22, as will be described in greater detail below.

The sides 40 of the shroud 24 can include at least one or a plurality of flanges 46. The flanges 46 can be used to couple the shroud 24 to the circuit board 16. The flanges 46 could be soldered to a surface 48 of the circuit board 16, or the flanges 46 could be press fit into the surface 48 of the circuit board 16, however, any appropriate method could be used to couple the shroud 24 to the circuit board 16, such as a mechanical fastener and/or adhesives. In addition, one or more of the flanges 46 can be used to couple the female USB terminal 26 to the shroud 24, as will be discussed in greater detail below.

Additionally, the shroud 24 can include one or more tabs 50 that can be disposed along the sides 40 to assist in transferring any loading to the shroud 24 to the circuit board 16. The tabs 50 can also serve to further shield the female USB terminal 26 from contaminants such as dust and other debris. The sides 40 can also include at least one or more apertures 52 which can be used to balance the shroud 24 on the circuit board 16 by enabling the adjustment of a center of gravity of the shroud 24. It will be understood that not all applications will require the apertures 52.

The top surface 38 of the shroud 24 can include one or more of engagement members 54. The engagement members 54 can extend from a rear surface 56 of the top surface 38 to engage a rear surface 58 of the female USB terminal 26. Generally, the engagement members 54 can be bent from the rear surface 56 prior to coupling the shroud 24 to the female USB terminal 26. Alternately, the engagement members 54 may be bent from the rear surface 56 after the bottom surface 36 of the shroud 24 has contacted the cut-out 44 in the circuit board 16. The engagement members 54 can ensure that the shroud 24 is properly disposed around the female USB terminal 26 prior to securing the shroud 24 to the circuit board 16. The top surface 38 can further define a first locking portion or locking aperture 60. The locking aperture 60 can be configured to engage the male connector system 22 (FIG. 1) to fixedly couple the female connector system 20 to the male connector system 22 (FIG. 1).

Figure 3:
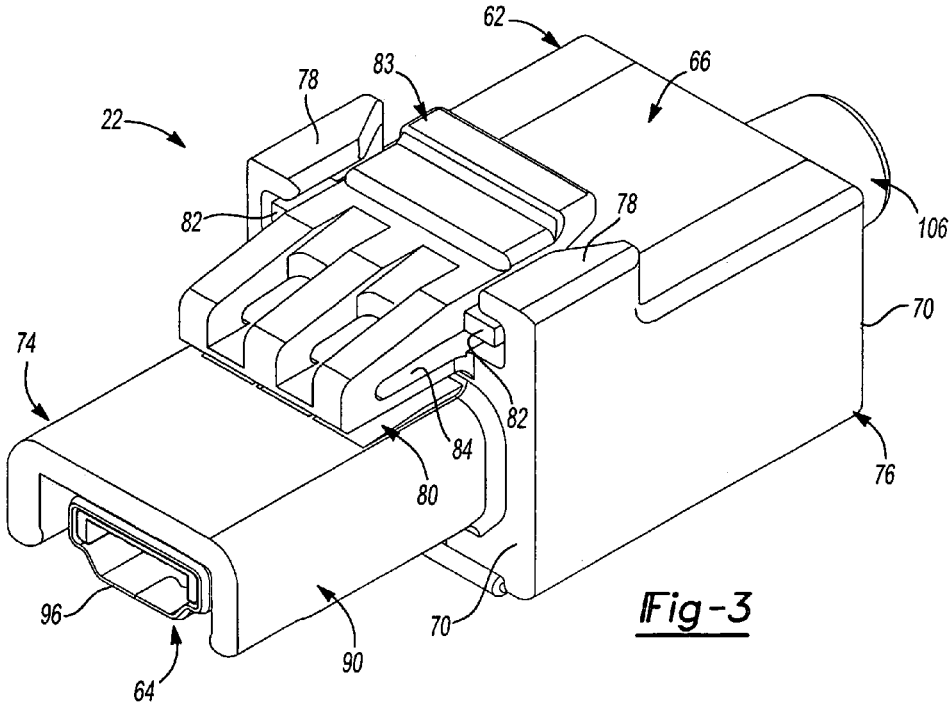
FIG. 3 is a perspective view of the USB locking connector system of FIG. 1, illustrating a female connector system.

With reference to FIGS. 3, 4 and 5, the male connector system 22 can include a second housing or shroud 62 which can be configured to mate with the locking aperture 60. The male connector system 22 can also include a male USB interface connector 64 which can be secured to and surrounded by the shroud 62. The shroud 62 can include a top surface 66 and a bottom surface 68 coupled together by at least one or a plurality of sides 70. The shroud 62 can be composed of a polymeric material with high thermal resistance, such as polybutylene terephthalate (PBT) with about fifteen percent glass filler, however any appropriate material could be employed. An opening 72 can be defined by the top surface 66, bottom surface 68 and sides 70, and may extend from a first end 74 to a second end 76. The opening 72 can enable the receipt of the male USB interface connector 64 therethrough, as will be discussed further below.

The top surface 66 of the shroud 62 can define at least one or pair of flanges 78 and a housing lock 80 at the first end 74. The flanges 78 can each be configured to constrain a tab 82 extending from a top surface 83 of the housing lock 80. The interaction between the tabs 82 and flanges 78 can provide audible feedback to an operator (not shown) that the shroud 62 of the male connector system 22 is fixedly coupled to the shroud 24 of the female connector system 20 as will be described in greater detail below.

The top surface 83 of the housing lock 80 can be cantilevered from a bottom surface 84 of the housing lock 80 to provide a spring force to resist the engagement of a second locking portion or projection 86 formed on the bottom surface 84 with the locking aperture 60. As will be discussed in greater detail below, the flanges 78 can serve to force the top surface 83 to be compressed against the bottom surface 84 prior to the engagement of the projection 86 with the locking aperture 60 of the shroud 24. In addition, the use of the housing lock 80 prevents the easy release of the female connector system 20 from the male connector system 22 as a high force can be required to re-compress the top surface 83 against the bottom surface 84 to remove the projection 86 from the locking aperture 60 of the shroud 24. It should also be noted that the use of a polymeric material with high thermal resistance ensures that the projection 86 can remain firmly engaged with the locking aperture 60 even in high temperature environments, such as those found within the motor vehicle 10.

The projection 86 of the housing lock 82 can be positioned to contact a slot 88 defined in a cover or scoop 90. The scoop 90 can be formed on the first end 74 and can generally extend from the sides 70. The slot 88 can be configured to have a depth D which can be approximately equal to a thickness T of the shroud 24, and can extend for at least a length L3 along the scoop 90. The length L3 can be at least generally equivalent to a length L4 measured from the locking aperture 60 to an edge 92 of the shroud 24. The slot 88 thus enables a portion of the shroud 24 extending from the locking aperture 60 to the edge 92 to be retained beneath the bottom surface 84 of the housing lock 80.

The scoop 90 can be configured to slidably engage the shroud 24. The scoop 90 can surround a first end 94 of the male USB interface connector 64 to protect the first end 94 of the male USB interface connector 64 from stubbing or misalignment with the terminals 28 of the female USB terminal 26. The scoop 90 can generally extend slightly beyond an edge 96 of the male USB interface connector 64 and may extend a length L5 from the housing lock 80, which can be approximately equivalent to the length L of the bottom surface 36 of the shroud 24, to enable data communication between the female USB terminal 26 and the male USB interface connector 64 when the projection 86 of the housing lock 80 is retained in the locking aperture 60. The position of the male USB interface connector 64 within the scoop 90 can be defined by the engagement of the male USB interface connector 64 with a third locking portion or protrusion 98 formed on the bottom surface 68 of the shroud 62.

The protrusion 98 can generally include a ramped face 100 which terminates in a peak 102. The ramped face 100 serves to guide the male USB interface connector 64 into the scoop 90 and also ensures proper alignment between the male USB interface connector 64 and the scoop 90 prior to the engagement of the protrusion 98 with the male USB interface connector 64. The protrusion 98 can be generally formed on the bottom surface 68 at a distance which enables the male USB interface connector 64 to be in communication with the female USB terminal 26 when the locking aperture 60 and projection 86 on the housing lock 80 are engaged. The bottom surface 68 can also define a slot 101 for receipt of a tool (not shown) which can be used to pry the protrusion 98 out of engagement with the male USB interface connector 64 in case the male USB interface connector 64 needs to be repaired or replaced without requiring the disengagement of the female connector system 20 from the male connector system 22. However, it is to be understood that in the alternative the entire USB locking connector system 8 could be removed for servicing.

The male USB interface connector 64 can include the first end 94 in communication with and coupled to a second end 104 via a cable 106. The first end 94 can include a male USB interface 108 which can either be a mini-USB interface or a conventional USB interface depending upon the type of USB connection employed by the female USB terminal 26. The male USB interface 108 can include at least one or a plurality of contacts 110 configured to mate with the terminals 28 of the female USB terminal 26 to enable data communication between the male USB interface connector 64 and the hard drive 14 through the female USB terminal 26 and circuit board 16. It should be noted that as the male USB interface 108 and cable 106 can be substantially similar to a USB interface and cable 106 used in home computers and/or music playback equipment, a detailed discussion of this functionality or of the basic construction of the male USB interface 108 and cable 106 need not be provided herein.

The cable 106 can be fixedly coupled to the male USB interface 108 by either molding or any other appropriate method, such as a mechanical fastener. The cable 106 can include a locking mechanism or notch 112 formed near the first end 94. The notch 112 can be configured to mate with the ramped face 100 and the peak 102 of the protrusion 98. Generally the notch 112 can include a tapered surface 114 configured to mate with the ramped face 100 and a valley 116 configured to mate with the peak 102. The valley 116 and peak 102 of the protrusion 98 prevent the cable 106 from being pulled out of the male USB interface connector 64.

As generally known, the cable 106 can also include wiring (not specifically shown) to enable data communication between the first end 94 and the second end 104. The second end 104 can include a female USB terminal 118. The female USB terminal 118 can be configured the same as the female USB terminal 26, and thus, a detailed discussion of this functionality or of the basic construction of the female USB terminal 118 need not be provided herein. The female USB terminal 118 can be configured to receive a male USB interface (not shown) from the external media device 18 to enable data communication between the external media device 18 and the hard drive 14 of the media device 12.

In order to enable data communication between the external media device 18 and the media device 12, the wired contact posts 30 of the female USB terminal 26 can be coupled to the circuit board 16. Generally, the USB locking connector system 8 can be fully assembled prior to coupling the female USB terminal 26 to the circuit board 16, however, it will be understood that alternative assembly methods could be used depending upon the particular motor vehicle 10. In order to couple the female USB terminal 26 to the shroud 24, the engagement members 54 can be bent to engage the rear surface 58 of the female USB terminal 26 and the shroud 24 can be positioned over the female USB terminal 26. Next, at least one of the flanges 46 of the shroud 24 can be coupled to at least one of the flanges 32 of the female USB terminal 26 via welding, or any appropriate technique, such as soldering, mechanical fasteners and/or adhesives, to fixedly couple the female USB terminal 26 to the shroud 24.

Then, in order to couple the male connector system 22 to the female connector system 20, the male USB interface 108 can be coupled to the shroud 62 via the engagement of the notch 112 on the cable 106 with the protrusion 98 on the bottom surface 68 of the shroud 62. Once the male USB interface 108 is coupled to the shroud 62, the scoop 90 can be used to align the male USB interface 108 within the shroud 24 of the female connector system 20. As the scoop 90 can slidably engage the bottom surface 36 of the shroud 24, the scoop 90 can be inserted into the opening 42 of the shroud 24 until the housing lock 80 contacts the edge 92 of the shroud 24. Next, the top surface 83 of the housing lock 80 can be depressed and/or pushed onto the shroud 24 to raise the projection 86 to enable the shroud 24 to slidably engage the slot 88 of the scoop 90. The scoop 90 can be slid along inside the opening 42 of the shroud 24 until the projection 86 can engage the locking aperture 60. When the projection 86 engages the locking aperture 60, the force of compressing the top surface 83 against the bottom surface 84 of the housing lock 80 can cause the top surface 83 to spring back, and the tabs 82 to contact the flanges 78. The contact between the tabs 82 provides audible and/or tangible feedback to the assembler to notify the assembler that the male connector system 22 is fixedly coupled to the female connector system 20.

After the male connector system 22 is fixedly coupled to the female connector system 20, the wired contact posts 30 of the female USB terminal 26 can be coupled to the circuit board 16 to enable communication between the hard drive 14 of the media device 12 and the external media device 18. Then, the flanges 46 of the shroud 24 can be soldered to the circuit board 16 once the bottom surface 36 of the shroud 24 is adjacent to the cut-out 44 of the circuit board 16 to further secure the USB locking connector system 8 to the circuit board 16.

With the female connector system 20 coupled to the male connector system 22, the external media device 18 can be coupled to the female USB terminal 118 disposed at the second end 104, as best shown in FIG. 1. Then, data communication can be achieved between the external media device 18 and the media device 12 through the cable 106 and the USB locking connector system 8. Alternatively, it should be noted that an inline connector 120 could be coupled to a female USB terminal 118' via a male USB interface 122 (as shown in phantom in FIG. 1). The inline connector 120 can include a corresponding cable 106 which can also include the female USB terminal 118 at a second end 104. The inline connector 120 can be used to couple various cables 106 together to enable data communication between the media device 12 and the external device 18 over the various cables 106.

The description of these teachings is merely exemplary in nature and, thus, variations that do not depart from the gist of the teachings are intended to be within the scope of the teachings. Such variations are not to be regarded as a departure from the spirit and scope of the teachings.

What is claimed is:

1. A Universal Serial Bus (USB) locking connector system for a vehicle comprising:

a first housing formed a first locking portion through a top surface;

a female USB connector disposed within the first housing;

a male USB connector operable to mate with the female USB connector; and a second housing formed a second locking portion cantilevered on a top surface of the second housing, the male USB connector being received in the second housing, the second locking portion pivotable to lockingly engage the first locking portion when the male USB connector is coupled to the female USB connector; wherein a third locking portion defines within the second housing; wherein the male USB connector includes a fourth locking portion configured to engage the third locking portion to lock the male USB connector to the second housing; and wherein a first end of the second housing includes the second locking portion, the first end configured to protect the male USB connector and to slidably engage the first housing; and a projection formed on the first end, the projection forming the second locking portion, the projection operable to engage the first locking portion of the female USB connector to lock the female USB connector to the male USB connector.

2. The USB locking connector system of claim 1, wherein the second housing further comprises:

an opening defined in the second housing for receipt of the male USB connector through the second housing.

3. The USB locking connector system of claim 2, wherein the second housing further comprises:

a second end configured to enclose an end of the male USB connector; and a protrusion formed on the second end of the second housing, the protrusion extending into the opening, the protrusion forming the third locking portion, the protrusion operable to engage the fourth locking portion of the male USB connector to fixedly couple the male USB connector to the second housing.

4. The USB locking connector system of claim 3, wherein the male USB connector further comprises:

a first end configured to engage the female USB connector, the first end configured to reside within the second housing to enable the male USB connector to be guided into to the first housing prior to engagement with the female USB connector;

an opening defined on the first end of the male USB connector, the opening operable to form the fourth locking portion, the opening configured to mate with the protrusion of the second housing to lock the male USB connector to the second housing; and a second end defining a female USB connector.

5. The USB locking connector system of claim 4, further comprising:

a first media device in communication with the female USB connector;

a second media device configured to be selectively coupled to the second end of the male USB connector; and wherein the female USB connector and male USB connector enable data transfer between the first media device and second media device.

6. The USB locking connector system of claim 5, wherein the first housing further comprises:

at least one flange operable to couple the first housing to the first media device to enable the female USB connector to be in communication with the first media device;

a first opening defined in the first housing, the first opening forming the first locking portion, the first opening configured to receive the second locking portion of the second housing to secure the first housing to the second housing;

a second opening defined in the first housing, the second opening operable to receive the second housing and female USB connector; and wherein the female USB connector is disposed within the first housing at a distance from the second opening to enable proper alignment of the female USB connector and male USB connector prior to the engagement of the first locking portion of the first housing and the second locking portion of the second housing.

7. The USB locking connector system of claim 1, wherein the female USB connector is a mini-USB terminal, and the male USB connector is a mini-USB compatible interface.

8. A Universal Serial Bus (USB) locking connector system for a vehicle comprising:

a first housing adapted to be coupled to the vehicle, the first housing including a first locking portion defined through a top surface of the first housing;

a USB terminal adapted to be disposed within to the first housing;

a second housing adapted to mate with the first housing, the second housing including a second locking portion formed on a top surface of the second housing, the second locking portion cantilevered on the top surface of the second housing, and a third locking portion;

a USB interface configured to be received in the second housing, the USB interface including a fourth locking portion adapted to mate with the third locking portion of the second housing to fixedly couple the USB interface to the second housing; and wherein the engagement of the first locking portion of the first housing and the second locking portion of the second housing fixedly couples the USB terminal to the USB interface; wherein a first end of the second housing includes the second locking portion, the first end configured to protect the USB interface and to slidably engage the first housing; a projection formed on the first end, the projection forming the third locking portion, the projection operable to engage the USB interface to lock the USB interface to the second housing.

9. The USB locking connector system of claim 8, wherein the second housing further comprises:

an opening defined in the second housing for receipt of the USB interface through the second housing and a second end configured to enclose an end of the USB interface, the second end including the third locking portion.

10. The USB locking connector system of claim 9, wherein the USB interface further comprises:

a first end configured to engage the USB terminal, the first end configured to reside within the second housing to enable the USB interface to be guided into to the first housing prior to engagement with the USB terminal;

an opening defined in the first end, the opening operable to form the fourth locking portion, the opening configured to mate with the projection of the second housing; and a second end adapted to be coupled to an external device in the vehicle.

11. The USB locking connector system of claim 10, wherein the first housing further comprises:

at least one flange operable to couple the first housing to the vehicle;

a first opening defined in the first housing, the first opening forming the first locking portion, the first opening configured to receive the second locking portion of the second housing to secure the first housing to the second housing;

a second opening defined in the first housing, the second opening operable to receive the second housing and USB interface; and wherein the USB terminal is disposed within the first housing at a distance from the opening to enable proper alignment of the USB terminal and USB interface prior to the engagement of the first locking portion of the first housing and the second locking portion of the second housing.

12. The USB locking connector system of claim 11, wherein the second locking portion of the second housing includes a projection configured to mate with the second opening to lock the first housing to the second housing.

13. The USB locking connector system of claim 12, wherein the USB terminal is a mini-USB terminal and the USB interface is a mini-USB compatible interface.

14. A media system for a vehicle comprising:

a first media device coupled to the vehicle;

a second media device configured to be selectively coupled to the vehicle;

a USB locking connector system operable to enable data transfer between the first media device and the second media device, the USB locking connector system comprising:

a female USB connector mechanism coupled to the first media device, the female USB connector mechanism including a first locking portion;

a male USB connector mechanism configured to be selectively coupled to the second media device, the male USB connector mechanism operable to be fixedly coupled to the female USB connector mechanism to enable data transfer between the second media device and the first media device, the male USB connector mechanism including a second locking portion cantilevered on a top surface of the male USB connector mechanism; and wherein the engagement of the first locking portion with the second locking portion fixedly couples the female USB connector mechanism to the male USB connector mechanism; wherein the male USB connector mechanism further comprises: a male USB connector, the male USB connector defining a third locking portion; a first shroud, the first shroud defining a fourth locking portion; and wherein the engagement of the third locking portion with the fourth locking portion fixedly couples the male USB connector to the first shroud.

15. The media system of claim 14, wherein the first shroud further comprises:

an opening defined in the first shroud for receipt of the male USB connector through the first shroud;

a first end including the second locking portion, the first end configured to protect the male USB connector and to slidably engage the female USB mechanism; and a projection formed on the first end, the projection forming the second locking portion, the projection operable to engage the first locking portion of the female USB connector mechanism to lock the female USB connector mechanism to the male USB connector.

16. The media system of claim 15, wherein the female USB connector mechanism further comprises:

a female USB connector;

a second shroud operable to receive the female USB connector; and wherein the female USB connector is disposed within the second shroud at a distance from the opening to enable proper alignment of the female USB connector and male USB connector prior to the engagement of the first locking portion of the second shroud and the second locking portion of the first shroud.

17. The media system of claim 16, wherein the second shroud further comprises:

at least one flange operable to couple the second shroud to the first media device to enable the female USB connector to be in communication with the first media device;

a first opening defined in the second shroud, the first opening forming the first locking portion, the first opening configured to receive the second locking portion of the first shroud to secure the second shroud to the first shroud; and a second opening defined in the second shroud, the second opening operable to receive the first shroud and female USB connector.

18. The media system of claim 17, wherein the male USB connector mechanism further comprises:

a first end configured to engage the female USB connector, the first end configured to reside within the first shroud to enable the male USB connector to be guided into to the second shroud prior to engagement with the female USB connector; and a second end defining a female USB connector operable to be selectively coupled to the second media device.

19. The media of claim 18, wherein the female USB connector is a mini-USB terminal, and the male USB connector is a mini-USB compatible interface.

* * * * *